US010347415B2

(12) United States Patent
Kanbe

(10) Patent No.: US 10,347,415 B2
(45) Date of Patent: Jul. 9, 2019

(54) COIL COMPONENT

(71) Applicant: Murata Manufacturing Co., Ltd., Kyoto (JP)

(72) Inventor: Yuki Kanbe, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 4 days.

(21) Appl. No.: 15/015,282

(22) Filed: Feb. 4, 2016

(65) Prior Publication Data

US 2016/0240306 A1 Aug. 18, 2016

(30) Foreign Application Priority Data

Feb. 13, 2015 (JP) ..... 2015-026741

(51) Int. Cl.
*H01F 27/29* (2006.01)
*H01F 17/04* (2006.01)
(Continued)

(52) U.S. Cl.
CPC ..... *H01F 27/292* (2013.01); *H01F 17/045* (2013.01); *H01F 27/2828* (2013.01); *H01F 2017/0093* (2013.01)

(58) Field of Classification Search
CPC .. H01F 27/292; H01F 27/29; H01F 2027/065; H01F 27/325
(Continued)

(56) References Cited

U.S. PATENT DOCUMENTS 3,671,813 A * 6/1972 Wilcox ..... H01L 23/49811 174/541
3,689,684 A * 9/1972 Cox, Jr. ..... H01L 21/4853 174/261
(Continued)

FOREIGN PATENT DOCUMENTS

DE 69936008 T2 1/2008
EP 0945880 A2 9/1999
(Continued)

OTHER PUBLICATIONS

Notification of the First Office Action issued by the State Intellectual Property Office of the People's Republic of China dated Jan. 2, 2018, which corresponds to Chinese Patent Application No. 201610068925.9 and is related to U.S. Appl. No. 15/015,282.
(Continued)

*Primary Examiner* — Alexander Talpalatski
*Assistant Examiner* — Joselito Baisa
(74) *Attorney, Agent, or Firm* — Studebaker & Brackett PC

(57) ABSTRACT

A coil component has a core having a winding core portion and a flange portion disposed on each of both ends of the winding core portion, the flange portion including a foot portion; a wire wound around the winding core portion; an electrode portion disposed on a bottom surface of the foot portion of the flange portion and connected to the wire; a metal terminal to be connected via a mounting solder to a mounting substrate; and a joining member connecting the metal terminal to the electrode portion. The joining member has a heat resistance property retaining a connection state between the electrode portion and the metal terminal at least at the melting point of the mounting solder.

14 Claims, 7 Drawing Sheets

(51) Int. Cl.
*H01F 27/28* (2006.01)
*H01F 17/00* (2006.01)

(58) Field of Classification Search
USPC ..... 336/192
See application file for complete search history.

(56) References Cited

U.S. PATENT DOCUMENTS 4,323,293 A * 4/1982 DeRouen ..... H05K 3/3405 257/669
5,462,443 A * 10/1995 Kurbjuhn ..... H01R 12/57 439/78
6,181,544 B1 * 1/2001 Nakagawa ..... H01G 4/228 361/306.1
6,310,759 B2 * 10/2001 Ishigaki ..... H01G 4/232 361/309
6,523,235 B1 * 2/2003 Ishigaki ..... H01G 4/232 228/248.1
6,688,892 B2 * 2/2004 Fukumoto ..... H01R 13/04 439/65
6,903,920 B1 * 6/2005 Prymak ..... H01G 2/065 361/306.1
7,345,316 B2 * 3/2008 Sherrer ..... G02B 6/4201 257/432
7,843,301 B2 * 11/2010 Shoji ..... H01F 17/045 336/192
8,315,035 B2 * 11/2012 Togashi ..... H01G 2/06 361/306.1
8,331,078 B2 * 12/2012 McConnell ..... H01G 4/232 361/303
8,520,390 B2 * 8/2013 Okamoto ..... H01P 1/218 174/544
9,613,753 B2 * 4/2017 Maeda ..... H01G 4/30
2001/0001258 A1 5/2001 Ishigaki et al.
2002/0023765 A1 * 2/2002 Sugiura ..... H01L 21/50 174/564
2003/0189817 A1 10/2003 Yoshii et al.
2005/0174205 A1 8/2005 Kitagawa
2009/0002112 A1 * 1/2009 Atsushi ..... H01F 17/045 336/83
2010/0123995 A1 * 5/2010 Otsuka ..... H01G 2/06 361/308.1
2010/0188798 A1 * 7/2010 Togashi ..... H01G 2/06 361/306.3
2010/0246099 A1 * 9/2010 Naka ..... H01G 2/14 361/534
2011/0151730 A1 * 6/2011 Kim ..... H01M 2/0404 439/884
2012/0040128 A1 * 2/2012 Finn ..... G06K 19/07783 428/96
2012/0043854 A1 * 2/2012 Otsuka ..... H01G 2/065 310/311
2013/0094991 A1 4/2013 Nagata et al.
2014/0001636 A1 * 1/2014 Saito ..... C25D 5/12 257/753
2014/0097928 A1 * 4/2014 Tomonari ..... H01F 27/28 336/207
2014/0292464 A1 * 10/2014 Takagi ..... H01F 27/29 336/192
2015/0042436 A1 * 2/2015 Arimitsu ..... H01F 27/29 336/192

FOREIGN PATENT DOCUMENTS

JP S62-204308 U 12/1987
JP H05-036548 A 2/1993
JP H07-094347 A 4/1995
JP 2000-036417 A 2/2000
JP 2003-303732 A 10/2003
JP 2004-288847 A 10/2004
JP 2005-223147 A 8/2005
JP 2007-234769 A 9/2007
JP 2009-141200 A 6/2009
JP 2012-006067 A 1/2012
JP 4862900 B2 1/2012

OTHER PUBLICATIONS

An Office Action; "Notification of Reasons for Rejection," issued by the Japanese Patent Office dated Mar. 27, 2018, which corresponds to Japanese Patent Application No. 2015-026741 and is related to U.S. Appl. No. 15/015,282.

* cited by examiner

COIL COMPONENT

CROSS REFERENCE TO RELATED APPLICATIONS

This application claims benefit of priority to Japanese Patent Application 2015-026741 filed Feb. 13, 2015, the entire content of which is incorporated herein by reference.

TECHNICAL FIELD

The present disclosure relates to a coil component.

BACKGROUND

Conventional electronic components having metal terminals include an electronic component described in Japanese Patent No. 4862900. This electronic component is a multilayer capacitor having an element body made up of a plurality of laminated dielectric layers, a terminal electrode formed to cover an end surface of the element body, and a metal terminal disposed around the element body. The metal terminal is connected by solder to the terminal electrode.

SUMMARY

Problem to be Solved by the Disclosure

In Japanese Patent No. 4862900, if the electronic component is reflow-mounted on a mounting substrate by solder and the melting point of the solder used for connecting the metal terminal and the terminal electrode is lower than or the same as the melting point of the solder used for connecting the metal terminal and the mounting substrate, the solder connecting the metal terminal and the terminal electrode may melt at the time of the reflow mounting. This may lead to a significant displacement or rotation of the metal terminal from the element body, reducing reliability of electric connection between the metal terminal and the terminal electrode or resulting in a size of the electronic component not falling within a predetermined range.

Therefore, a problem of the present disclosure is to provide a coil component preventing a positional displacement of a metal terminal relative to a core.

Solutions to the Problems

To solve the problem, the present disclosure provides a coil component comprising:

a core having a winding core portion and a flange portion disposed on each of both ends of the winding core portion, the flange portion including a foot portion;

a wire wound around the winding core portion;

an electrode portion disposed on a bottom surface of the foot portion of the flange portion and connected to the wire;

a metal terminal to be connected via a mounting solder to a mounting substrate; and a joining member connecting the metal terminal to the electrode portion, wherein the joining member has a heat resistance property retaining a connection state between the electrode portion and the metal terminal at least at the melting point of the mounting solder.

According to the coil component of the present disclosure, since the joining member has the heat resistance property retaining the connection state between the electrode portion and the metal terminal at least at the melting point of the mounting solder, the joining member has a melting point higher than the mounting solder, for example. Therefore, when the metal terminal is connected to the mounting substrate by reflow, the joining member hardly melts even if the mounting solder is melted at the melting point of the mounting solder. Thus, a positional displacement of the metal terminal relative to the core can be prevented at the time of reflow.

Preferably, in the coil component of an embodiment, the foot portion has a cutout disposed on a side surface, and the joining member is embedded in the cutout.

According to the coil component of the embodiment, since the foot portion has a cutout disposed on a side surface, and the joining member is embedded in the cutout, the joining member is connected also to the flange portion and the joining member is enhanced in resistance to a thermal shock cycle.

Preferably, in the coil component of an embodiment, the metal terminal has a first connecting portion connected to the electrode portion, a second connecting portion to be connected to the mounting substrate, and a coupling portion coupling the first connecting portion and the second connecting portion such that the first connecting portion and the second connecting portion have a difference in height.

According to the coil component of the embodiment, the first connecting portion connected to the electrode portion and the second connecting portion to be connected to the mounting substrate are coupled to have a difference in height. When the second connecting portion is connected by the mounting solder to the mounting substrate, this reduces mixing of the joining member connecting the first connecting portion and the electrode portion with the mounting solder connecting the second connecting portion and the mounting substrate, so as to prevent lowering of the melting point of the joining member.

Preferably, in the coil component of an embodiment, an end portion of the coupling portion closer to the first connecting portion is positioned immediately under the bottom surface of the foot portion.

According to the coil component of the embodiment, since the end portion of the coupling portion closer to the first connecting portion is positioned immediately under the bottom surface of the foot portion, the end portion of the coupling portion is connected to the bottom surface of the foot portion and, when a load is applied in the horizontal direction to the coil component, the moment of force around the second connecting portion corresponding to this load is made smaller and the metal terminal hardly bends.

Preferably, in the coil component of an embodiment, the second connecting portion is disposed with a rising portion for connection by the mounting solder.

According to the coil component of the embodiment, since the second connecting portion is disposed with the rising portion for connection by the mounting solder, a fillet of the mounting solder is formed and the connection to the mounting substrate can be checked with AOI (Automatic Optical Inspection machine: substrate appearance inspection device) etc.

Preferably, in the coil component of an embodiment, the metal terminal is not positioned immediately under a winding portion of the wire wound around the winding core portion.

According to the coil component of the embodiment, since the metal terminal is not positioned immediately under the winding portion of the wire wound around the winding core portion, when the coil component is coated with a resin, the resin does not accumulate between the winding portion of the wire and the metal terminal. Therefore, the resin does not integrally connect the winding portion of the wire and the metal terminal. Thus, the resin is not dragged by expansion and contraction of the metal terminal and is not subjected to a stress due to the expansion and contraction of the metal terminal. As a result, the wire is not subjected to the stress due to the expansion and contraction of the metal terminal via the resin. Therefore, the wire can be prevented from breaking due to a thermal shock cycle.

Preferably, in the coil component of an embodiment, the metal terminal is connected by thermocompression bonding via the joining member to the electrode portion.

According to the coil component of the embodiment, since the metal terminal is connected by thermocompression bonding via the joining member to the electrode portion, the metal terminal and the electrode portion can be joined in a short time so as to suppress generation of an intermetallic compound causing a crack of the joining member.

Preferably, in the coil component of an embodiment, the joining member is made of a Sn—Sb-based solder.

According to the coil component of the embodiment, since the joining member is made of a Sn—Sb-based solder, the joining member has the melting point higher than the mounting solder. Therefore, a positional displacement of the metal terminal relative to the core can be prevented at the time of reflow.

Preferably, in the coil component of an embodiment, the joining member is made of a Bi-based solder.

According to the coil component of the embodiment, since the joining member is made of a Bi-based solder, the Young's modulus and the linear expansion coefficient of the joining member are low. Therefore, the joining member is enhanced in thermal shock resistance.

Preferably, in the coil component of an embodiment, the joining member is made of a conductive adhesive.

According to the coil component of the embodiment, since the joining member is made of a conductive adhesive, the joining member can be prevented from melting due to reflow.

Effect of the Disclosure

According to the coil component of the present disclosure, since the joining member has the heat resistance property retaining the connection state between the electrode portion and the metal terminal at least at the melting point of the mounting solder, the positional displacement of the metal terminal relative to the core can be prevented.

DETAILED DESCRIPTION

The present disclosure will now be described in detail with reference to shown embodiments.

First Embodiment

Figure 1:
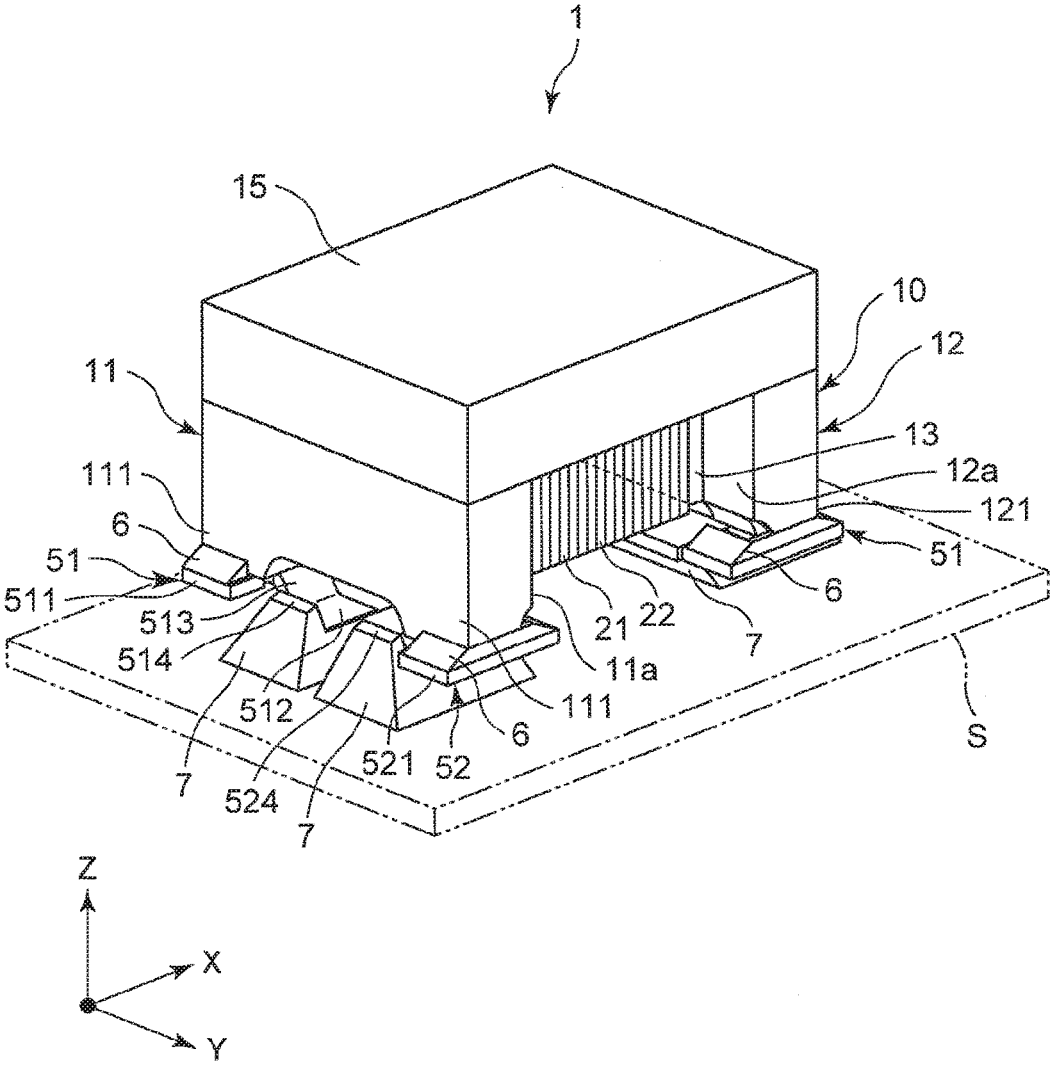
FIG. 1 is a perspective view of a coil component of a first embodiment of the present disclosure.
Figure 2:
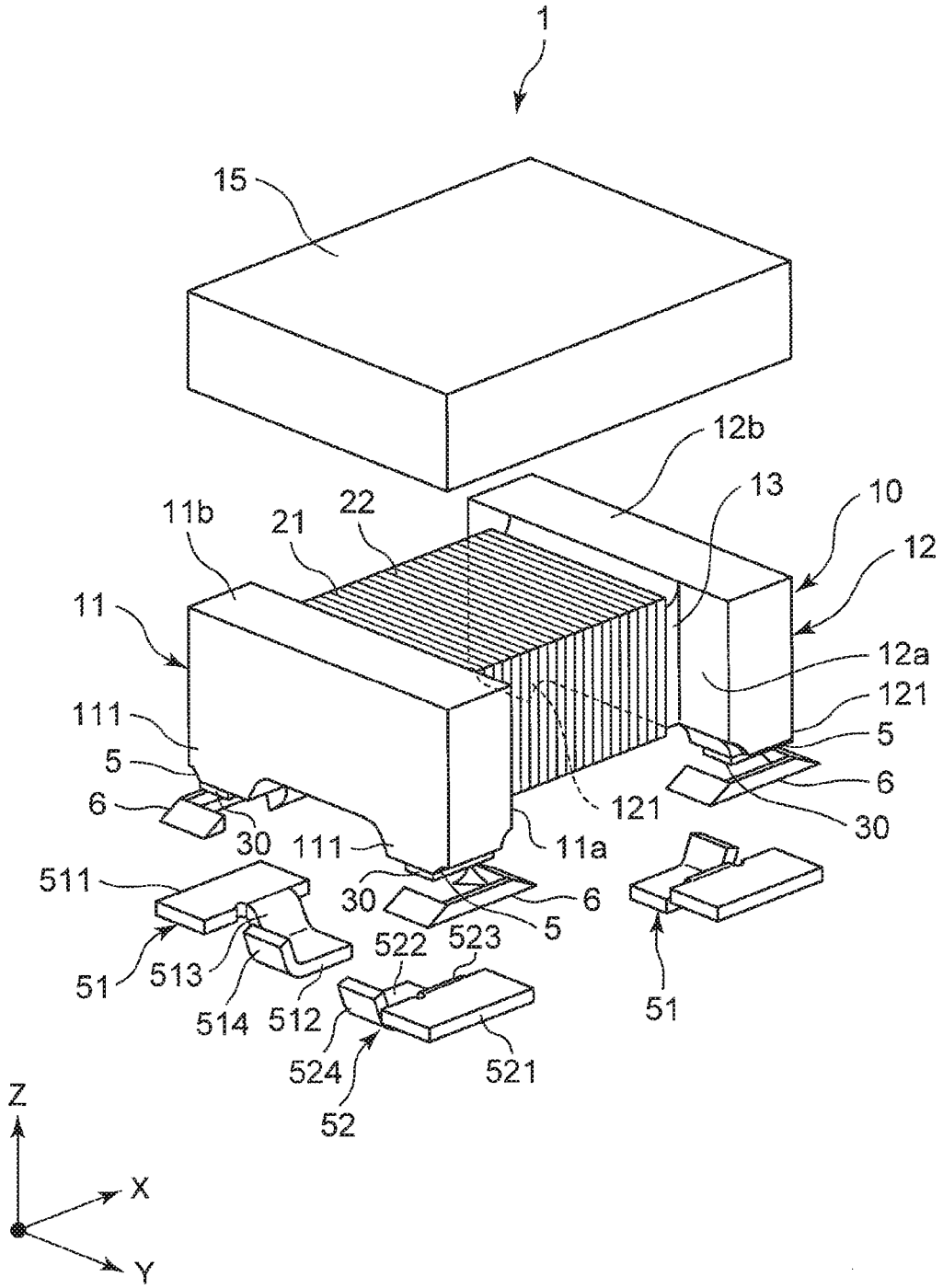
FIG. 2 is an exploded perspective view of the coil component.

FIG. 1 is a perspective view of a coil component of a first embodiment of the present disclosure. FIG. 2 is an exploded perspective view of the coil component. As shown in FIGS. 1 and 2, a coil component 1 is a common mode choke coil. The coil component 1 has a core 10; first and second wires 21, 22 wound around the core 10; electrode portions 30 disposed on the core 10; first and second metal terminals 51, 52 to be connected to a mounting substrate S; joining members 6 connecting the first and second metal terminals 51, 52 to the electrode portions 30; and a plate member 15 disposed on the core 10.

The core 10 has a winding core portion 13, a first flange portion 11 disposed at one axial end of the winding core portion 13, a second flange portion 12 disposed at the other axial end of the winding core portion 13. The core 10 is made of a material having a dielectric constant of 20 or less, for example, alumina (non-magnetic material), Ni—Zn-based ferrite (magnetic material, insulating material), and resin.

A bottom surface of the core 10 is defined as a surface mounted on the mounting substrate S, and a top surface of the core is defined as a surface on the side opposite to the bottom surface of the core 10. A direction (axial direction) connecting one end and the other end of the winding core portion 13 is defined as an X-direction, a direction orthogonal to the X-direction on the bottom surface of the core 10 is defined as a Y-direction, and a direction connecting the bottom surface and the top surface of the core 10 is defined as a Z-direction. The Z-direction is orthogonal to the X-direction and the Y-direction. The X-direction is defined as the length direction of the coil component 1, the Y-direction is defined as the width direction of the coil component 1, and the Z-direction is defined as the height direction of the coil component 1.

The winding core portion 13 axially extends from one end toward the other end thereof. The shape of the winding core portion 13 is a rectangular parallelepiped. The shape of the winding core portion 13 may be another shape such as a circular column.

An end surface 11*a* of the first flange portion 11 is connected to one end of the winding core portion 13. The first flange portion 11 has two foot portions 111 on the bottom surface side of the core 10. The two foot portions 111 are spaced and arranged in the Y-direction.

An end surface 12*a* of the second flange portion 12 is connected to the other end of the winding core portion 13. The second flange portion 12 has two foot portions 121 on the bottom surface side of the core 10. The two foot portions 121 are spaced and arranged in the Y-direction.

One of the foot portions 111 of the first flange portion 11 faces one of the foot portions 121 of the second flange portion 12 in the X-direction. The other foot portion 111 of the first flange portion 11 faces the other foot portion 121 of the second flange portion 12 in the X-direction.

The plate member 15 is attached to a top surface 11*b* of the first flange portion 11 and a top surface 12*b* of the second flange portion 12. The plate member 15 is made of the same material as the core 10. The core 10 and the plate member 15 make up a closed magnetic circuit.

The electrode portions 30 are disposed on the two foot portions 111 of the first flange portion 11 and the two foot portions 121 of the second flange portion 12. The electrode portions 30 are made of a material such as Ag, for example.

The first and second wires 21, 22 are wound in a coil shape around the winding core portion 13. The first and second wires 21, 22 are wound as a pair at the same time, for example, and this is referred to as bifilar winding. The first and second wires 21, 22 have, for example, conductors made of Cu, Ag, Au, etc. and coating films covering the conductors.

One end of the first wire 21 is electrically connected to the electrode portion 30 of the one foot portion 111 of the first flange portion 11, and the other end of the first wire 21 is electrically connected to the electrode portion 30 of the one foot portion 121 of the second flange portion 12.

One end of the second wire 22 is electrically connected to the electrode portion 30 of the other foot portion 111 of the first flange portion 11, and the other end of the second wire 22 is electrically connected to the electrode portion 30 of the other foot portion 121 of the second flange portion 12.

The first and second metal terminals 51, 52 are electrically connected to the electrode portions 30 and the mounting substrate S to conductively connect the electrode portion 30 and the mounting substrate S. The first and second metal terminals 51, 52 are formed by, for example, bending a metal plate of Cu, Ag, Au, etc. The first metal terminals 51 and the second metal terminals 52 are bilaterally symmetrically formed.

The first metal terminals 51 are each connected to the one foot portion 111 of the first flange portion 11 and the other foot portion 121 of the second flange portion 12. The second metal terminals 52 are each connected to the other foot portion 111 of the first flange portion 11 and the one foot portion 121 of the second flange portion 12.

The first and second metal terminals 51, 52 are electrically connected via mounting solders 7 to the mounting substrate S. The mounting solders 7 are made of low-temperature solder, for example, a Sn—Pb-based solder. The melting point of the mounting solders 7 is lower than 220° C.

The first and second metal terminals 51, 52 are electrically connected via joining members 6 to the electrode portions 30. The joining members 6 are made of high-temperature solder and has a melting point higher than the melting point of the mounting solders 7. The melting point of the joining members 6 is higher than 220° C.

In short, the coil component 1 is characterized in that the joining members 6 have a heat resistance property retaining a connection state between the electrode portions 30 and the first and second metal terminals 51, 52 at least at the melting point of the mounting solders 7. Retaining the connection state means that relative positions are retained between the electrode portions 30 and the first and second metal terminals 51, 52.

According to the coil component 1, when the first and second metal terminals 51, 52 are connected to the mounting substrate S by reflow, the joining members 6 hardly melt even if the mounting solders 7 are melted at the melting point of the mounting solders 7. Therefore, the positional displacement of the first and second metal terminals 51, 52 relative to the core 10 can be prevented at the time of reflow.

The joining members 6 are made of a Sn—Sb-based solder, for example. As a result, the joining members 6 have a melting point higher than the mounting solders 7. Therefore, the positional displacement of the first and second metal terminals 51, 52 can more reliably be prevented.

The joining members 6 may be made of a Bi-based solder. As a result, the Young's modulus and the linear expansion coefficient of the joining members 6 are low. Therefore, the joining members 6 are enhanced in thermal shock resistance.

The joining member 6 may be made of a conductive adhesive. The conductive adhesive is, for example, a thermosetting resin containing a metal filler such as Ag, Au, and Cu. The sublimation point of the conductive adhesive is higher than the melting point of the mounting solders 7. As a result, the joining members 6 can be prevented from melting due to reflow.

Figure 3:
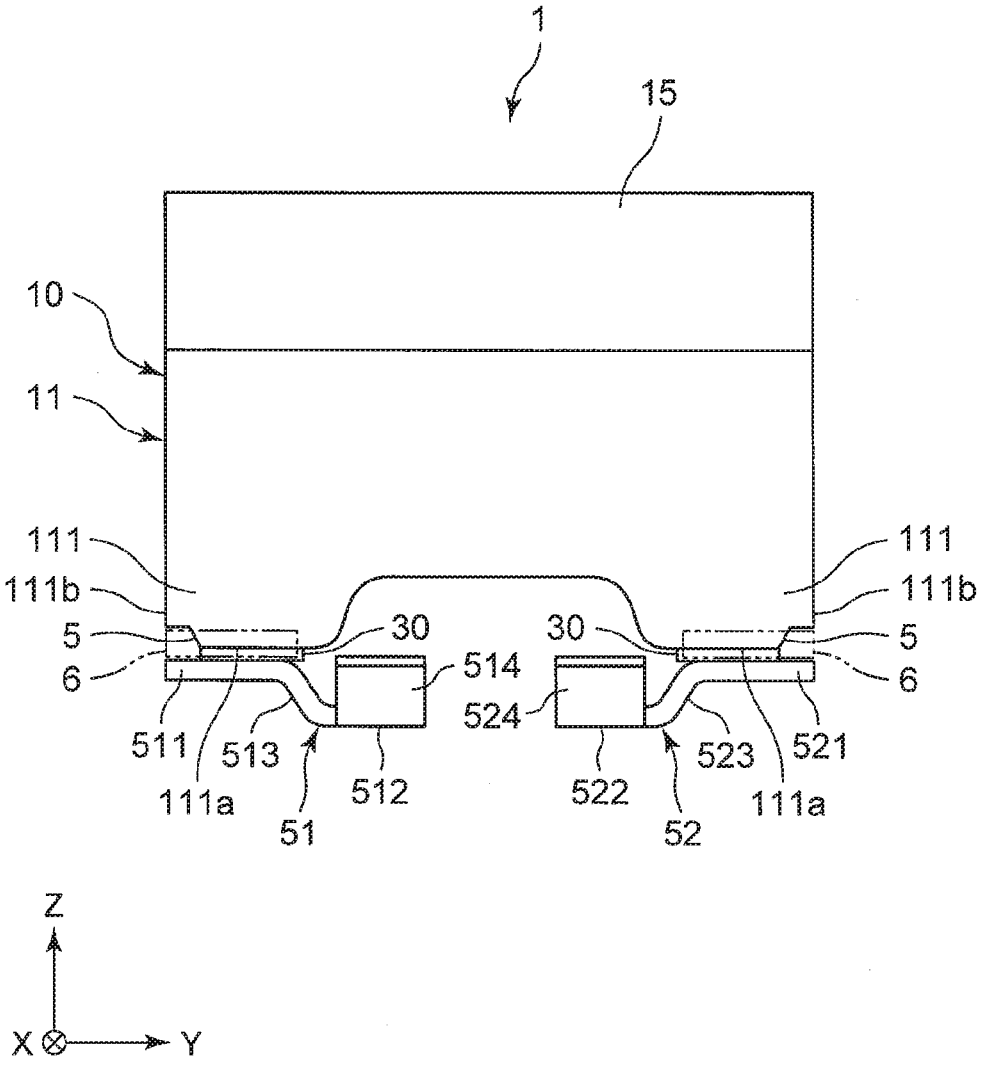
FIG. 3 is a side view of the coil component viewed in an X-direction.
Figure 4:
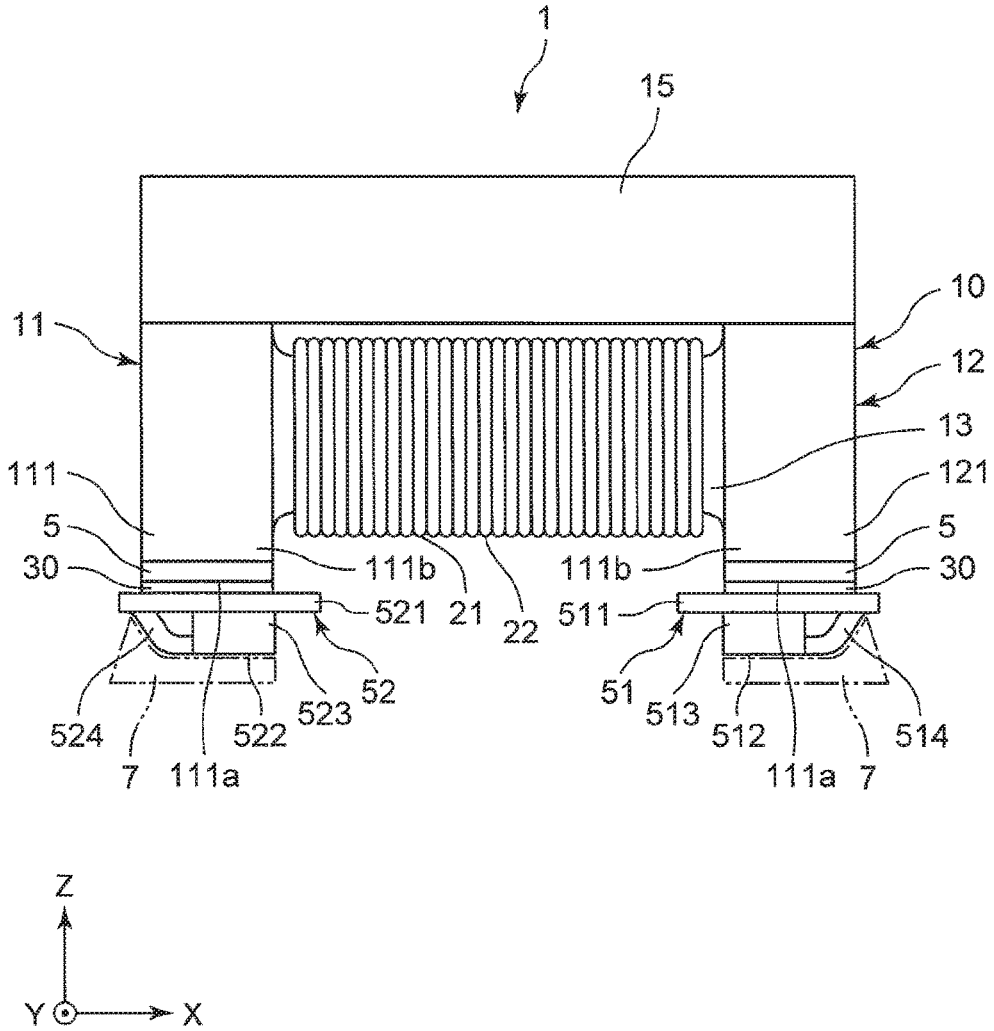
FIG. 4 is a side view of the coil component viewed in a Y-direction.

FIG. 3 is a side view of the coil component 1 viewed in the X-direction. FIG. 4 is a side view of the coil component 1 viewed in the Y-direction.

As shown in FIGS. 2, 3, and 4, each of the foot portions 111 of the first flange portion 11 has a bottom surface 111*a* and a side surface 111*b* facing outward in the Y-direction. The bottom surface 111*a* is disposed with the electrode portion 30. The side surface 111*b* is disposed with a cutout 5 cut out toward the bottom surface 111*a*. The joining member 6 is embedded in the cutout 5.

Similarly, each of the foot portions 121 of the second flange portion 12 has a bottom surface 121*a* and a side surface 121*b*, the bottom surface 121*a* is disposed with the electrode portion 30, and the side surface 121*b* is disposed with a cutout 5. The joining member 6 is embedded in the cutout 5.

Therefore, since the joining members 6 are embedded in the cutouts 5, the joining members 6 are connected also to the first and second flange portions 11, 12, and the joining members 6 are enhanced in resistance to a thermal shock cycle. The thermal shock cycle means that a high temperature and a low temperature are repeated for each predetermined time.

The first metal terminal 51 has a first connecting portion 511 connected to the electrode portion 30, a second connecting portion 512 to be connected to the mounting substrate S, and a coupling portion 513 coupling the first connecting portion 511 and the second connecting portion 512 such that the first connecting portion 511 and the second connecting portion 512 have a difference in height.

The first connecting portion 511 is positioned higher than the second connecting portion 512 in the Z-direction. The second connecting portion 512 is positioned on the inside relative to the first connecting portion 511 in the Y-direction. The inside means the center side of the coil component 1 and the same applies to the following description. The coupling portion 513 extends in the Y-direction and couples a Y-direction end portion of the first connecting portion 511 closer to the second connecting portion 512 and a Y-direction end portion of the second connecting portion 512 closer to the first connecting portion 511.

Similarly, the second metal terminal 52 has a first connecting portion 521, a second connecting portion 522, and a coupling portion 523. The first connecting portion 521 is connected to the electrode portion 30. The second connecting portion 522 is connected to the mounting substrate S. The coupling portion 523 couples the first connecting portion 521 and the second connecting portion 522 such that the first connecting portion 521 and the second connecting portion 522 have a difference in height.

Therefore, since the first connecting portions 511, 521 and the second connecting portions 512, 522 are coupled to have a difference in height, when the second connecting portions 512, 522 are connected by the mounting solders 7 to the mounting substrate S, this reduces mixing of the joining members 6 connecting the first connecting portions 511, 521 and the electrode portions 30 with the mounting solders 7 connecting the second connecting portions 512, 522 and the mounting substrate S, so as to prevent lowering of the melting point of the joining members 6.

The first and second metal terminals 51, 52 are connected by thermocompression bonding via the joining members 6 to the electrode portions 30. For example, after the joining member 6 is applied in advance to an upper surface of the first connecting portion 511 of the first metal terminal 51, the joining member 6 on the upper surface of the first connecting portion 511 is brought into contact with the electrode portion 30, and a heated heater chip is applied to a lower surface of the first connecting portion 511. As a result, the joining member 6 is melted and the first connecting portion 511 is connected via the joining member 6 to the electrode portion 30. The second metal terminal 52 is connected in the same way.

Therefore, since the first and second metal terminals 51, 52 are connected by thermocompression bonding via the joining members 6 to the electrode portions 30, the first and second metal terminals 51, 52 and the electrode portions 30 can be joined in a short time so as to suppress generation of an intermetallic compound causing a crack of the joining members 6. In contrast, if the metal terminals and the electrode portions are joined by reflow, a longer heating time results in the generation of the intermetallic compound in a larger amount and a crack may occur in the joining members.

As shown in FIG. 3, on the side of the first flange portion 11, an end portion of the coupling portion 513 of the first metal terminal 51 closer to the first connecting portion 511 is positioned immediately under the bottom surface 111*a* of the foot portion 111. An end portion of the coupling portion 523 of the second metal terminal 52 closer to the first connecting portion 521 is positioned immediately under the bottom surface 111*a* of the foot portion 111. The side of the second flange portion 12 has the same configuration and therefore will not be described.

Thus, since the end portion of the coupling portion 513 of the first metal terminal 51 is connected to the bottom surface 111*a* of the foot portion 111, when a load is applied in the horizontal direction to the coil component 1, the moment of force around the second connecting portion 512 corresponding to this load is made smaller and the first metal terminal 51 hardly bends. The second metal terminal 52 has the same effect.

As shown in FIG. 4, the second connecting portion 512 of first metal terminal 51 is disposed with a rising portion 514 for connection by the mounting solder 7. The rising portion 514 rises outward in the X-direction. Similarly, the second connecting portion 522 of the second metal terminal 52 is disposed with a rising portion 524.

Therefore, when the mounting solders 7 are connected to the rising portions 514, 524, the fillets of the mounting solders 7 are formed and the connection to the mounting substrate S can be checked with AOI (Automatic Optical Inspection machine: substrate appearance inspection device) etc.

Figure 5:
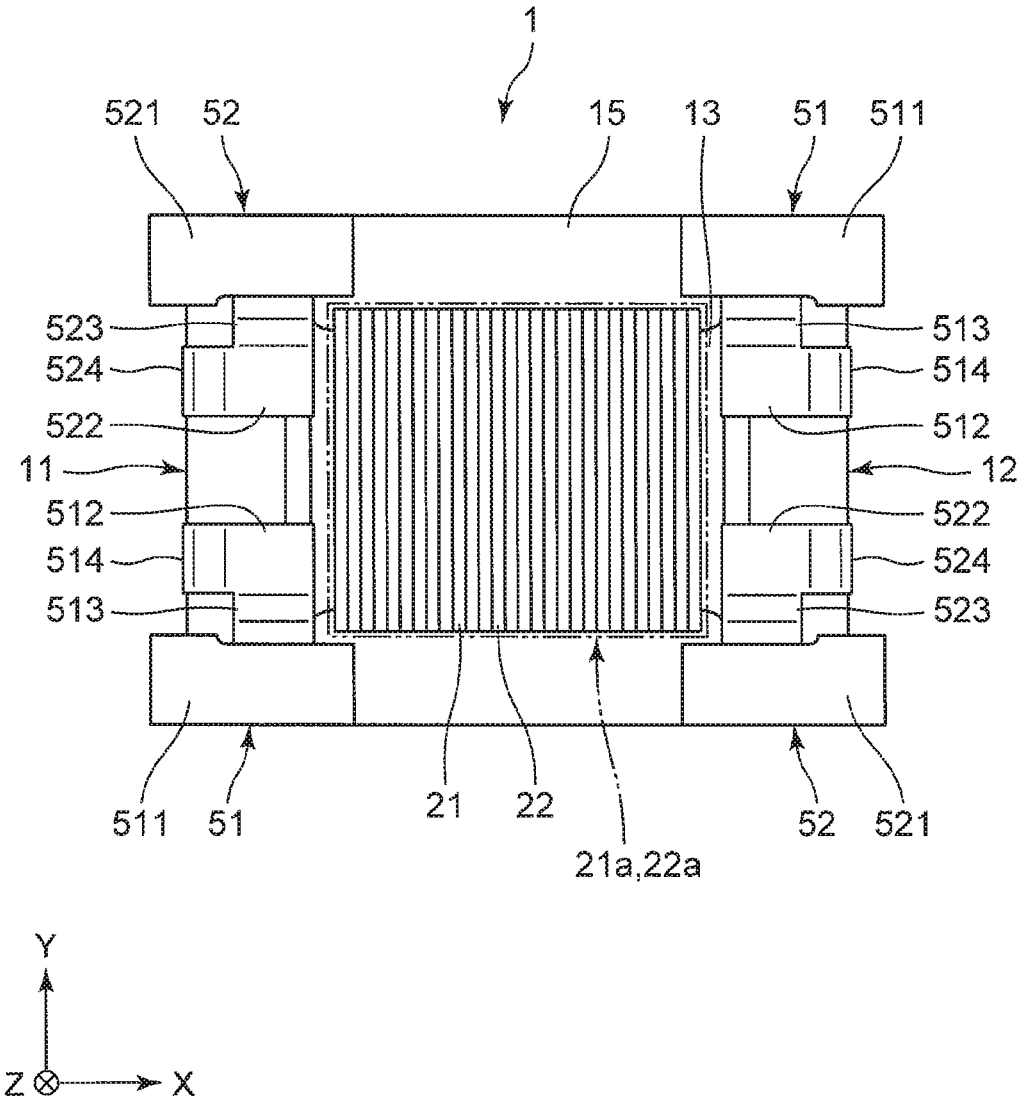
FIG. 5 is a bottom view of the coil component.

FIG. 5 is a bottom view of the coil component 1. As shown in FIG. 5, the first metal terminals 51 are not positioned immediately under a winding portion 21*a* of the first wire 21 wound around the winding core portion 13 and a winding portion 22*a* of the second wire 22 wound around the winding core portion 13. In FIG. 5, the winding portions 21*a*, 22*a* are indicated by a box of dashed-two dotted lines. Similarly, the second metal terminals 52 are not positioned immediately under the winding portion 21*a* of the first wire 21 and the winding portion 22*a* of the second wire 22.

Therefore, when coil component 1 is coated with a resin not shown, the resin does not accumulate between the winding portions 21*a*, 22*a* of the first and second wires 21, 22 and the first and second metal terminals 51, 52. Therefore, the resin does not integrally connect the winding portions 21*a*, 22*a* of the first and second wires 21, 22 and the first and second metal terminals 51, 52. Thus, the resin is not dragged by expansion and contraction of the first and second metal terminals 51, 52 and is not subjected to a stress due to the expansion and contraction of the first and second metal terminals 51, 52. As a result, the first and second wires 21, 22 (especially, connection parts of the first and second wires 21, 22 to the electrode portions 30) are not subjected to the stress due to the expansion and contraction of the first and second metal terminals 51, 52 via the resin. Therefore, the first and second wires 21, 22 can be prevented from breaking due to the thermal shock cycle.

Second Embodiment

Figure 6:
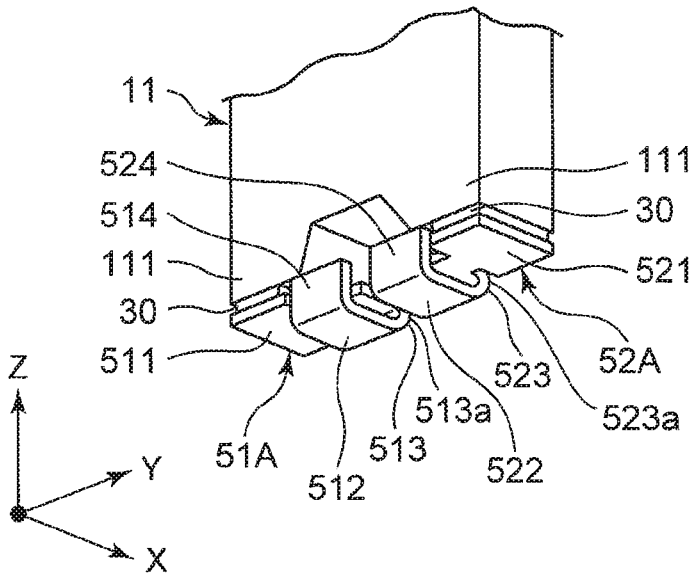
FIG. 6 is a perspective view of a coil component of a second embodiment of the present disclosure viewed from the bottom surface side.

FIG. 6 is a perspective view of a coil component of a second embodiment of the present disclosure viewed from the bottom surface side. The second embodiment is different from the first embodiment only in the configuration of the first and second metal terminals. Only this different configuration will hereinafter be described.

As shown in FIG. 6, a first metal terminal 51A has the first connecting portion 511 connected to the electrode portion 30, the second connecting portion 512 to be connected to the mounting substrate S, and the coupling portion 513 coupling the first connecting portion 511 and the second connecting portion 512 such that the first connecting portion 511 and the second connecting portion 512 have a difference in height. The second connecting portion 512 is disposed with the rising portion 514.

The first connecting portion 511, the second connecting portion 512, and the rising portion 514 are configured in the same way as the first connecting portion, the second connecting portion, and the rising portion of the first embodiment. The coupling portion 513 is bent in the X-direction to couple a Y-direction inside end portion of the first connecting portion 511 and an X-direction inside end portion of the second connecting portion 512. A bending portion 513*a* of the coupling portion 513 is positioned inside in the X-direction.

Similarly, a second metal terminal 52A has the first connecting portion 521, the second connecting portion 522, the coupling portion 523 including a bending portion 523*a*, and the rising portion 524.

Therefore, the second embodiment has the same effect as the first embodiment.

Third Embodiment

Figure 7:
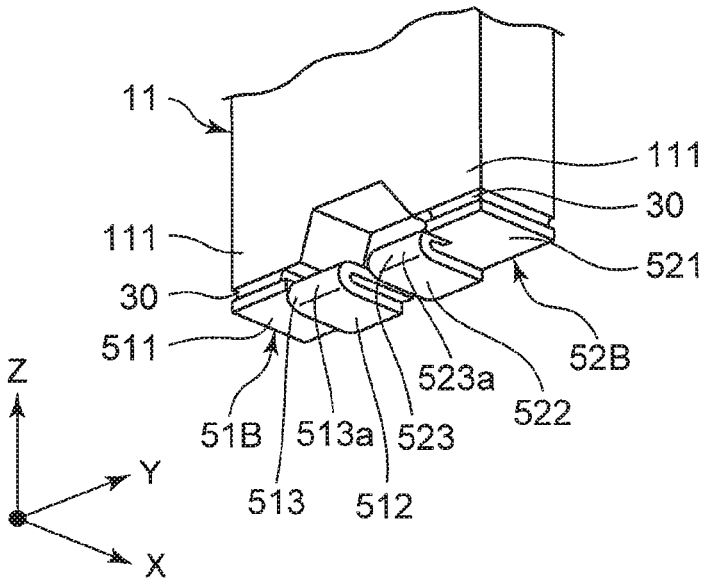
FIG. 7 is a perspective view of a coil component of a third embodiment of the present disclosure viewed from the bottom surface side.

FIG. 7 is a perspective view of a coil component of a third embodiment of the present disclosure viewed from the bottom surface side. The third embodiment is different from the first embodiment only in the configuration of the first and second metal terminals. Only this different configuration will hereinafter be described.

As shown in FIG. 7, a first metal terminal 51B has the first connecting portion 511 connected to the electrode portion 30, the second connecting portion 512 to be connected to the mounting substrate S, and the coupling portion 513 coupling the first connecting portion 511 and the second connecting portion 512 such that the first connecting portion 511 and the second connecting portion 512 have a difference in height.

The first connecting portion 511 and the second connecting portion 512 are configured in the same way as the first connecting portion and the second connecting portion of the first embodiment. The coupling portion 513 is bent in the X-direction to couple a Y-direction inside end portion of the first connecting portion 511 and an X-direction outside end portion of the second connecting portion 512. The bending portion 513*a* of the coupling portion 513 is positioned outside in the X-direction. The bending portion 513*a* also has the function of the rising portion of the first embodiment.

Similarly, a second metal terminal 52B has the first connecting portion 521, the second connecting portion 522, and the coupling portion 523 including the bending portion 523*a*.

Therefore, the third embodiment has the same effect as the first embodiment. As compared to the first and second metal terminals of the first embodiment, the rising portion can be eliminated and the cost of members can be reduced.

The present disclosure is not limited to the embodiments described above and can be changed in design without departing from the spirit of the present disclosure. For example, the respective characteristic points of the first to third embodiments may variously be combined.

Although the coil component is a common mode choke coil in the embodiments, the coil component may be any coil component having a wire wound around a core, such as a pulse transformer.

Although the plate member is disposed in the embodiments, the plate member may not be included. Although two wires are disposed in the embodiments, the number of the wires may be one or three or more.

Although two foot portions are disposed on one flange portion in the embodiments, the number of the foot portions may be one or three or more.

Although two metal terminals are disposed on one flange portion in the embodiments, the number of the metal terminals may be one or three or more.

Although the electrode portion and the joining member are different members in the embodiments, the electrode portion and the joining member may be the same member.

Although the cutout of the foot portion is disposed in the Y-direction outer side surface of the foot portion in the embodiments, the cutout may be disposed in the Y-direction inner side surface of the foot portion, the X-direction outer side surface of the foot portion, the X-direction inner side surface of the foot portion, etc.

Although the first embodiment has all the configurations of a first configuration in which the melting point of the joining member is higher than the melting point of the mounting solder, a second configuration in which the foot portion is disposed with the cutout, a third configuration in which the metal terminal has the first connecting portion, the second connecting portion, and the coupling portion, a fourth configuration in which the end portion of the coupling portion is positioned immediately under the bottom surface of the foot portion, a fifth configuration in which the second connecting portion is disposed with the rising portion, and a sixth configuration in which the metal terminal is not positioned immediately under the winding portion of the wire, the coil component may have at least only the first configuration and, for example, the first configuration may be combined with at least one of the second to sixth configurations.

EXAMPLE

An example of the coil component of the first embodiment of the present disclosure will be described.

(Material and Manufacturing Method)

A common mode choke coil used as the coil component was produced as follows. First, after a glass-containing Ag thick film was applied by dipping to foot portions of an H-shaped core of Ni—Zn-based ferrite with relative permeability of 1000 and was fired at approximately 900° C., electroplating was applied in the order of Ni plating and Sn plating onto the Ag thick film to form electrode portions. Two wires having copper lines and insulating films made of enamel covering the copper lines were wound around the winding core portion of the core for a predetermined number of turns, and the terminals of the respective wires were thermocompression-bonded to the electrode portions.

Subsequently, after an epoxy adhesive was applied by dipping to the flange portions of the core on the side opposite to the electrode portions, a plate member of the NiZn-based ferrite with relative permeability of 1000 same as the core was affixed to form a closed magnetic circuit and the adhesive was thermally cured while the plate member is pressed.

Subsequently, the joining members made of Sn-10Sb solder was dispensed and applied to the metal terminals at positions to be joined to the electrode portions, and the core with the wound wires was mounted on the surfaces of the metal terminals to which the joining members were applied. A heater chip heated to approximately 350° C. was applied from the surfaces of the metal terminals opposite to the surfaces in contact with the electrode portions for approximately one second to melt the joining members and connect the core and the metal terminals. The common mode choke coil was produced in this way.

(First Experimental Result)

Figure 8:
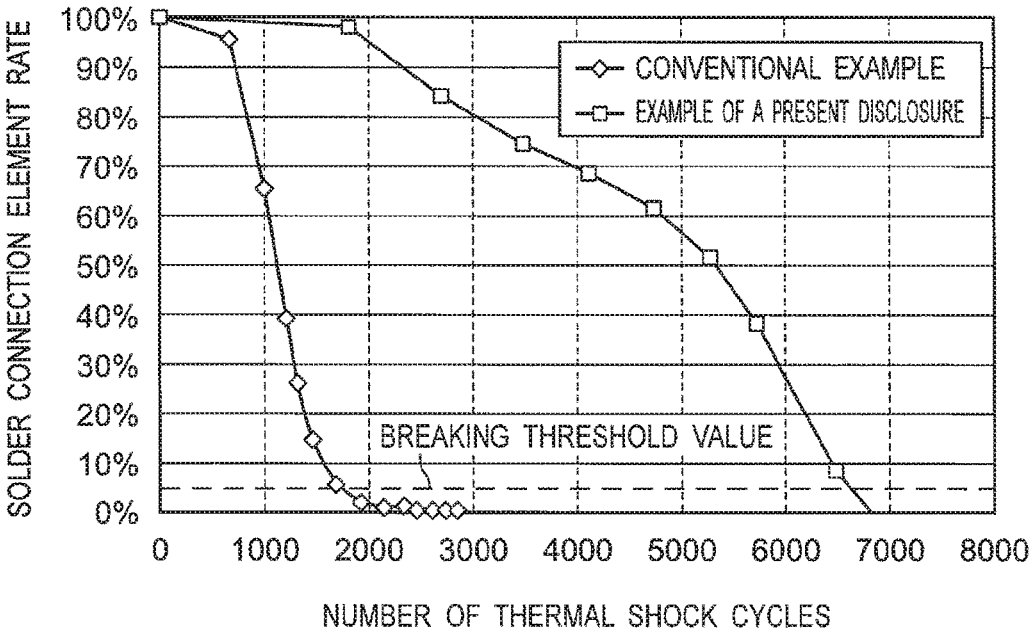
FIG. 8 is a graph of the life of mounting solders of an example of the present disclosure and a conventional example when a thermal shock is applied.

FIG. 8 shows simulation results of the example of the present disclosure and a conventional example having the configuration requirements of the example except for the metal terminals in terms of the life of mounting solder when thermal shocks of −55° C. and 150° C. are applied for 30 minutes each. The example of the present disclosure is plotted as squares and the conventional example is plotted as rhombuses. The vertical axis indicates a solder connection element rate such that a higher numerical value represents a better state of the mounting solder, and 5% is a threshold value at which the mounting solder breaks. The horizontal axis indicates the number of thermal shock cycles and a pair of −55° C. and 150° C. is defined as one cycle.

As can be seen from FIG. 8, the mounting solder of the conventional example broke in 1695 cycles. On the other hand, the example of the present disclosure broke in 6619 cycles. Therefore, the thermal shock resistance was significantly improved by connecting the metal terminals by the Sn-10Sb solder as in the example of the present disclosure.

(Second Experimental Result)

The thermal shock test described above was conducted for the example of the present disclosure and a conventional example having the configuration requirements of the example except for the cutouts of the core. As a result, the joining members of the conventional example broke in 4 out of 80 coil components in 500 cycles. In contrast, no joining member of the example of the present disclosure broke in 130 coil components even after 2000 cycles. Therefore, the thermal shock resistance was significantly improved by disposing the cutouts in the core as in the example of the present disclosure.

(Third Experimental Result)

A test was conducted by horizontally applying a load of 10 N to the example of the present disclosure and a conventional example having the end portions of the coupling portions of the metal terminals at positions away from under the bottom surfaces of the foot portions of the core. As a result, the coil component of the conventional example was rotated by the load. In contrast, since the moment of force was made smaller in the coupling portions of the metal terminals in the example of the present disclosure, the coil component was not rotated even when the load was applied.

(Fourth Experimental Result)

The thermal shock test described above was conducted for the example of the present disclosure and a conventional example having the metal terminals partially positioned immediately under the winding portion of the wire wound around the winding core portion, after resin coating of the coil components. As a result, the conventional example allowed the resin to accumulate between the winding portion of the wire and the metal terminals and the wire broke in 250 cycles. In contrast, the example of the present disclosure allowed no resin to accumulate between the winding portion of the wire and the metal terminals and, therefore, the wire did not break even after 1000 cycles.

The invention claimed is:

1. A coil component comprising:

a core having a winding core portion and a flange portion disposed on each of both ends of the winding core portion, the flange portion including two foot portions each protruding toward a bottom surface side of the core;

a wire wound around the winding core portion;

an electrode portion disposed on a bottom surface of one of the two foot portions of the flange portion and connected to the wire;

a metal terminal to be connected via a mounting solder to a mounting substrate; and a joining member connecting the metal terminal to the electrode portion, wherein the joining member has a heat resistance property retaining a connection state between the electrode portion and the metal terminal at least at the melting point of the mounting solder, the metal terminal has a first connecting portion connected to the electrode portion, a second connecting portion to be connected to the mounting substrate, and a coupling portion coupling the first connecting portion and the second connecting portion, the two foot portions are spaced from each other in a first direction along the bottom surface and perpendicular to a second direction connecting the one end and the other end of the winding core portion, the second connection portion is located substantially in a space between the two foot portions in the first direction, the second connecting portion has end edges opposing each other in the second direction and side edges opposing each other in the first direction, and the second connecting portion is disposed with a rising portion for connection by the mounting solder at one of the end edges and disposed with the coupling portion at the other one of the end edges or one of the side edges.

2. The coil component according to claim 1, wherein the one of the two foot portions has a cutout disposed on a side surface, and wherein the joining member is embedded in the cutout.

3. The coil component according to claim 1, wherein the first connecting portion and the second connecting portion have a difference in height.

4. The coil component according to claim 3, wherein an end portion of the coupling portion closer to the first connecting portion is positioned immediately under the bottom surface of the one of the two foot portions.

5. The coil component according to claim 1, wherein the metal terminal is not positioned immediately under a winding portion of the wire wound around the winding core portion.

6. The coil component according to claim 1, wherein the metal terminal is connected by thermocompression bonding via the joining member to the electrode portion.

7. The coil component according to claim 1, wherein the joining member is made of a Sn—Sb-based solder.

8. The coil component according to claim 1, wherein the joining member is made of a Bi-based solder.

9. The coil component according to claim 1, wherein the joining member is made of a conductive adhesive.

10. A coil component according to claim 1, wherein the second connecting portion is disposed with the coupling portion at the other one of the end edges.

11. A coil component comprising:

a core having a winding core portion and a flange portion disposed on each of both ends of the winding core portion, the flange portion including two foot portions each protruding toward a bottom surface side of the core;

a wire wound around the winding core portion;

an electrode portion disposed on a bottom surface of one of the two foot portions of the flange portion and connected to the wire;

a metal terminal to be connected via a mounting solder to a mounting substrate; and a joining member connecting the metal terminal to the electrode portion, wherein the joining member has a heat resistance property retaining a connection state between the electrode portion and the metal terminal at least at the melting point of the mounting solder, the metal terminal has a first connecting portion connected to the electrode portion, a second connecting portion to be connected to the mounting substrate, and a coupling portion coupling the first connecting portion and the second connecting portion, the first connecting portion and the second connecting portion do not overlap in plan view in a direction perpendicular to the bottom surface of the foot portion, the two foot portions are spaced from each other in a first direction along the bottom surface and perpendicular to a second direction connecting the one end and the other end of the winding core portion, the second connection portion is located substantially in a space between the two foot portions in the first direction, the second connecting portion has end edges opposing each other in the second direction and side edges opposing each other in the first direction, and the second connecting portion is disposed with a rising portion for connection by the mounting solder at one of the end edges and disposed with the coupling portion at the other one of the end edges or one of the side edges.

12. A coil component according to claim 11, wherein the second connecting portion is disposed with the coupling portion at the other one of the end edges.

13. A coil component comprising:

a core having a winding core portion and a flange portion disposed on each of both ends of the winding core portion, the flange portion including two foot portions each protruding toward a bottom surface side of the core;

a wire wound around the winding core portion;

an electrode portion disposed on a bottom surface of one of the two foot portions of the flange portion and connected to the wire;

a metal terminal to be connected via a mounting solder to a mounting substrate; and a joining member connecting the metal terminal to the electrode portion, wherein the joining member has a heat resistance property retaining a connection state between the electrode portion and the metal terminal at least at the melting point of the mounting solder, the metal terminal has a first connecting portion connected to the electrode portion, a second connecting portion to be connected to the mounting substrate, and a coupling portion coupling the first connecting portion and the second connecting portion, the foot portion has a cutout disposed on a side surface, and wherein the joining member is embedded in the cutout such that the joining member is in contact with the electrode portion and the flange portion, the two foot portions are spaced from each other in a first direction along the bottom surface and perpendicular to a second direction connecting the one end and the other end of the winding core portion, the second connection portion is located substantially in a space between the two foot portions in the first direction, the second connecting portion has end edges opposing each other in the second direction and side edges opposing each other in the first direction, and the second connecting portion is disposed with a rising portion for connection by the mounting solder at one of the end edges and disposed with the coupling portion at the other one of the end edges or one of the side edges.

14. A coil component according to claim 13, wherein the second connecting portion is disposed with the coupling portion at the other one of the end edges.

* * * * *